US006803716B1

(12) United States Patent
Park et al.

(10) Patent No.: US 6,803,716 B1
(45) Date of Patent: Oct. 12, 2004

(54) VACUUM FLUORESCENT DISPLAY

(75) Inventors: Chul-Woo Park, Ulsan (KR); Kwon-Soo Choi, Ulsan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 228 days.

(21) Appl. No.: 09/642,190

(22) Filed: Aug. 18, 2000

(30) Foreign Application Priority Data

Aug. 20, 1999 (KR) ..... 1999-34630
Mar. 24, 2000 (KR) ..... 2000-15011
Jun. 13, 2000 (KR) ..... 2000-32516

(51) Int. Cl.[7] ..... H01J 17/49
(52) U.S. Cl. ..... 313/495; 313/497
(58) Field of Search ..... 313/495–497, 313/422, 292, 283, 476; 315/366, 866

(56) References Cited

U.S. PATENT DOCUMENTS 5,643,034 A * 7/1997 Mohri et al. ..... 445/24
5,859,508 A * 1/1999 Ge et al. ..... 313/422

* cited by examiner

*Primary Examiner*—Ashok Patel
(74) *Attorney, Agent, or Firm*—Christie, Parker & Hale, LLP

(57) ABSTRACT

A vacuum fluorescent display includes a pair of substrates spaced apart from each other with a predetermined distance. The substrates form a vacuum cell by interposing a side glass. Filaments are mounted within the vacuum cell to emit thermal electrons under the application of voltage. Anode electrodes are formed at one of the substrates, each anode electrode unit having a conductive layer and a phosphor layer formed on the conductive layer. A control electrode surrounds the anode electrode to accelerate or intercept the thermal electrons emitted from the filaments. The control electrode is formed with a single-layered structure.

19 Claims, 7 Drawing Sheets

FIG.1 PRIOR ART
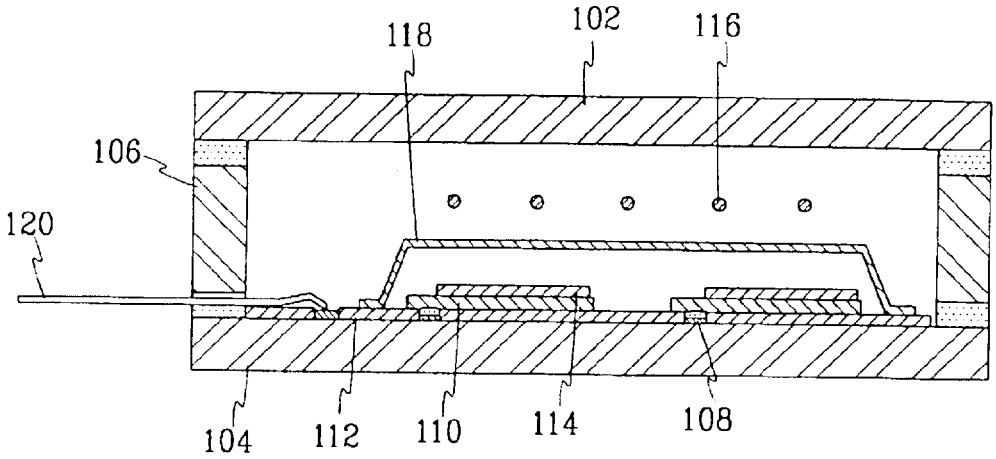
FIG.2 PRIOR ART
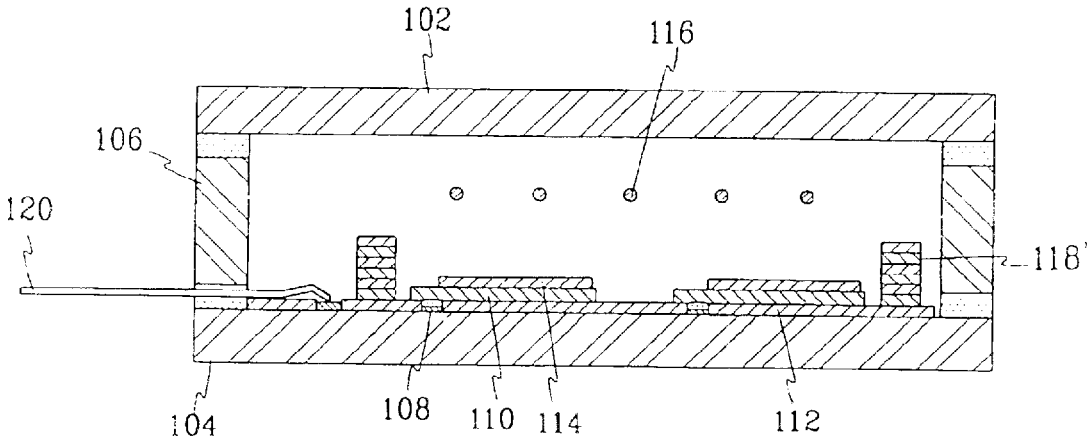

VACUUM FLUORESCENT DISPLAY

BACKGROUND OF THE INVENTION (a) Field of the Invention

The present invention relates to a vacuum fluorescent display (VFD) and, more particularly, to a vacuum fluorescent display which is provided with a metal rib for controlling thermal electrons extracted from filaments.

(b) Description of the Related Art

Generally, a vacuum fluorescent display is a display device where thermal electrons emitted from filaments are bombarded onto a phosphor layer while being controlled by a grid electrode and an anode electrode. Such a vacuum fluorescent display involves excellent visibility, wide viewing angle, low voltage driving, and high reliability.

The vacuum fluorescent displays may be formed with a diode structure, a triode structure, or a fourfold electrode structure. Among them, the triode-structured vacuum fluorescent display with filaments, anode electrodes, and control electrodes has been used most extensively.

Specifically, as shown in FIG. 1, the triode-structured vacuum fluorescent display includes a front substrate 102, a back substrate 104, and a side glass 106. A wiring layer 108 electrically interconnects the device components. An insulating layer 112 insulates a conductive layer 110 from the wiring layer 108 except the portions of through-holes to prevent unnecessary electrical shots. The conductive layer 110 makes electrical current to be flowed from the wiring layer 108 to the phosphor layer 114 via the through-holes. The phosphor layer 114 is printed at an anode electrode with a predetermined pattern. Filaments 116 are spaced apart from the anode electrode while standing in the side of the front substrate 102 to emit thermal electrons. A metal mesh-typed control electrode 118 accelerates or intercepts the thermal electrons emitted from the filaments 116.

In the above structure, when voltage is applied to the filaments 116, the anode electrode and the control electrode 118 through a lead line 120, thermal electrons are emitted from the filaments 116. The emitted thermal electrons are accelerated and diffused by the control electrode 118, and bombarded onto the phosphor layer 114 of the anode electrode, thereby producing the desired display images.

The control electrode 118 is formed with a mesh grid that has a mesh made through etching a thin metal plate based on SUS, and a support fitted around the periphery of the mesh. The support keeps the mesh to be placed at a predetermined position such that it can control the thermal electrons emitted from the filaments 116.

Accordingly, when the mesh grids 118 are mounted onto the back substrate 104, a predetermined distance should be kept between the support and the anode electrode as well as between the neighboring mesh grids 118 to make the thermal electrons to correctly land on the phosphor layer 114, and to prevent leakage of light between the neighboring phosphor layers 114. For this reason, it becomes difficult to design minute patterns or complex polygonal patterns in the vacuum fluorescent display using the mesh grid as a control electrode.

Furthermore, in the case of the mesh grid 118, the central portion of the mesh may be sunk due to thermal deformation during the manufacturing process and at use. In this case, the capacity of the mesh grid 118 for accelerating and diffusing thermal electrons is deteriorated, and hence, the neighboring phosphor layers 114 covered by the mesh grids 118 are differentiated in brightness.

Therefore, it is inevitable that the number of the supports should increase to prevent the central portion of the mesh grid 118 from being sunk. This is also an obstacle to patterning the anode electrode in a free manner.

Recently, it has been suggested that a conductive rib may be placed at the periphery of the anode electrode to function as a control grid instead of the mesh grid that involves disadvantages in structural aspect as well as in production cost.

In such a structure, as shown in FIG. 2, a conductive rib 118' is provided at the periphery of the anode electrode with the conductive layer 110 and the phosphor layer 114. The conductive rib 118' is formed through repeatedly printing a conductive material onto the anode electrode such that it has a thickness capable of performing the desired electron control.

The conductive rib 118' is usually formed through thick-film printing. In the thick-film printing, a solution of a conductive material is printed onto the anode electrode by a thickness of 10–30 $\mu$m, and dried.

Such a process is repeated three to fifteen times to thereby complete a conductive rib with a thickness of 100–150 $\mu$m, and this involves troublesome and long-term works.

Furthermore, during the printing process, the conductive rib 118' and the neighboring anode electrode are liable to suffer electrical short.

In addition, the gas generated from the conductive material is left within the vacuum cell while prohibiting free flow of electrons there. This causes deterioration in brightness, accompanied with decreased life span of the device.

SUMMARY OF THE INVENTION

It is an object of the present invention to provide a vacuum fluorescent display which can be fabricated through simplified processing steps while involving improved performance characteristics.

This and other objects may be achieved by a vacuum fluorescent display including a pair of substrates spaced apart from each other with a predetermined distance. The substrates form a vacuum cell by interposing a side glass. Filaments are mounted within the vacuum cell to emit thermal electrons under the application of voltage. Anode electrodes are formed at one of the substrates, each anode electrode unit having a conductive layer and a phosphor layer formed on the conductive layer. A control electrode surrounds the anode electrode to accelerate or intercept the thermal electrons emitted from the filaments. The control electrode is formed with a single-layered structure.

The control electrode may be formed with a metallic material such as stainless steel, platinum, silver and copper.

The anode electrode unit is formed with a plurality of segments, and the control electrode surrounds each segment of the anode electrode unit. The control electrode is formed with a unitary part, or in a separate manner, and has a main control part for accelerating and intercepting the thermal electrons, and a subsidiary control part for assisting the main control part in controlling the thermal electrons. The main control part surrounds each segment of the anode electrode, and the subsidiary control part is formed at a top end portion of the main control unit in a body. The subsidiary control part is formed with an extension where the top end portion of the main control unit is extended toward each segment of the anode electrode perpendicular to the main control member.

Alternatively, the subsidiary control part may be formed with a connector interconnecting top ends of the main control part such that the connector crosses each segment of the anode electrode.

A subsidiary control electrode based on a mesh grid may surround one or more of the control electrode units.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein:

FIGS. 1 and 2 are cross sectional views of vacuum fluorescent displays according to prior arts;

DETAILED DESCRIPTION OF THE PREFERRED EMBODIMENTS

Preferred embodiments of this invention will be explained with reference to the accompanying drawings.

Figure 3:
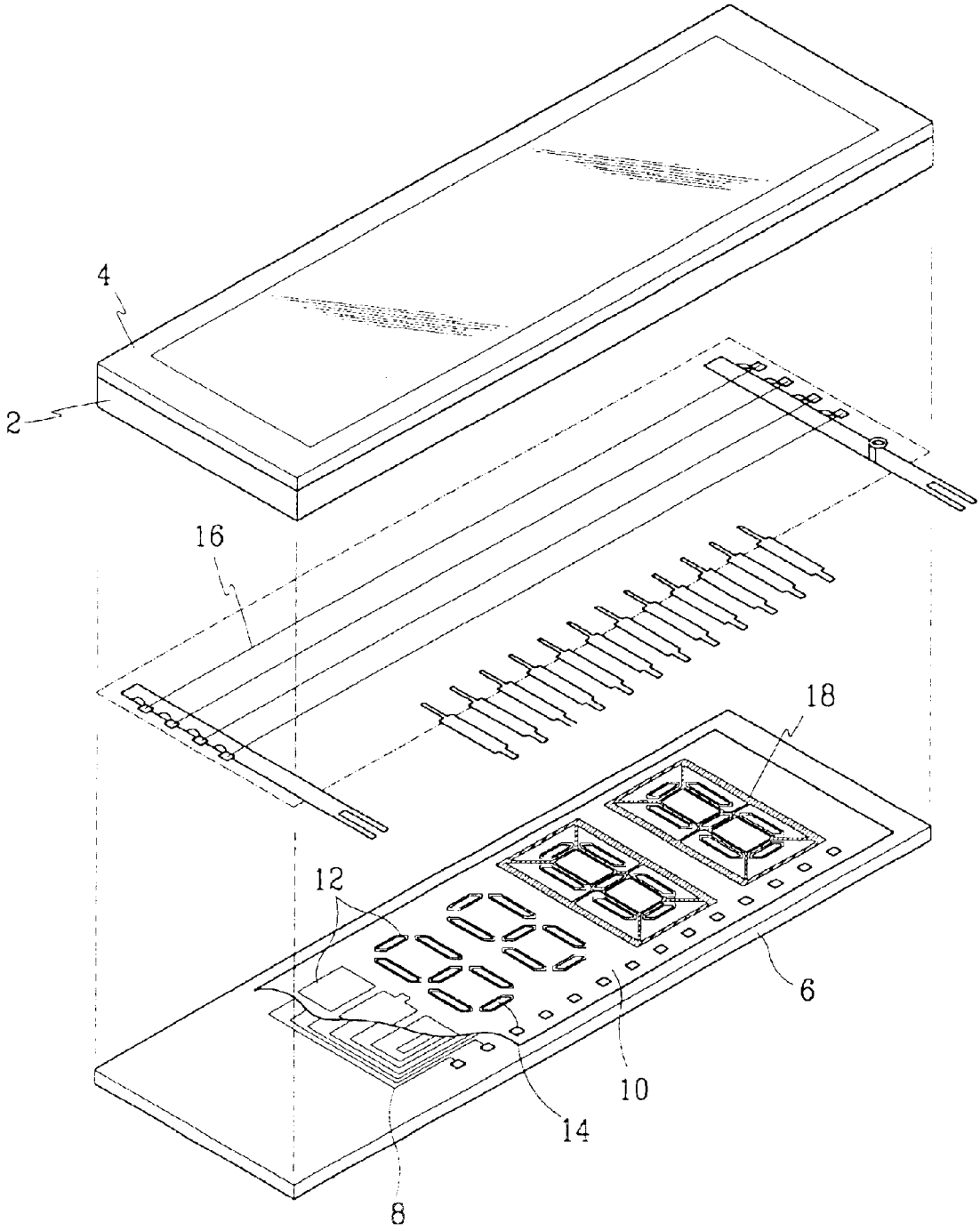
FIG. 3 is an exploded perspective view of a vacuum fluorescent display according to a first preferred embodiment of the present invention.
Figure 4:
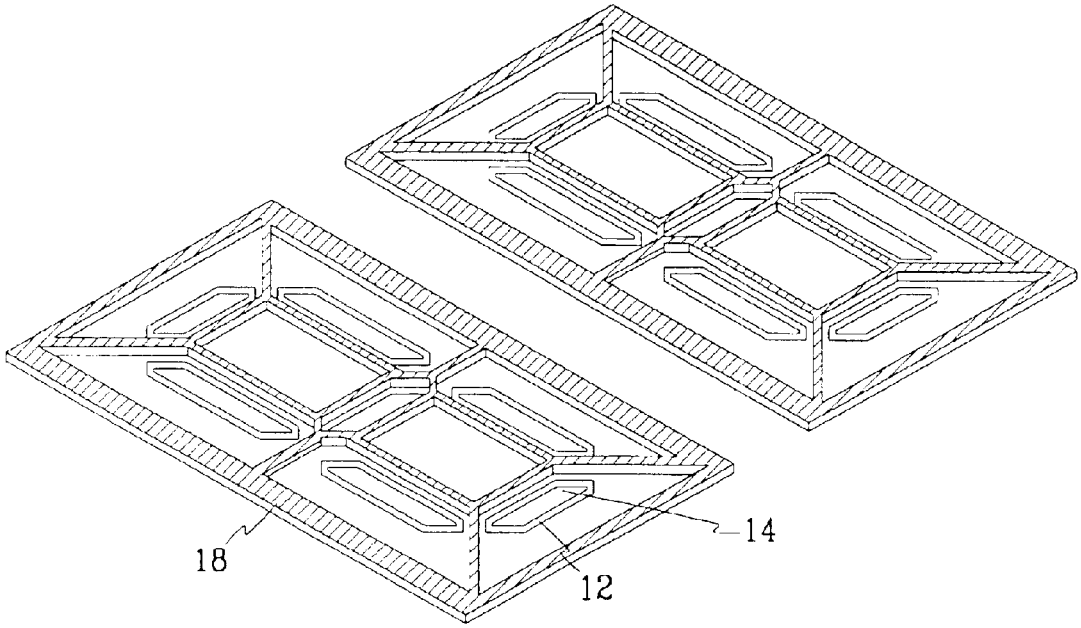
FIG. 4 is an amplified view of the vacuum fluorescent display shown in FIG. 3.
Figure 5:
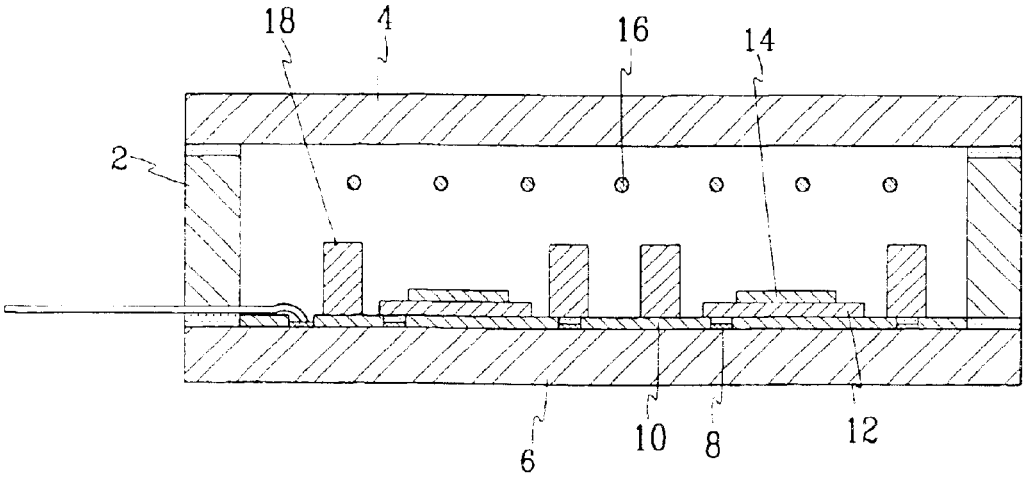
FIG. 5 is a combinatorial sectional view of the vacuum fluorescent display shown in FIG. 3.

FIG. 3 is an exploded perspective view of a vacuum fluorescent display according to a first preferred embodiment of the present invention, FIG. 4 is an amplified view of the vacuum fluorescent display, and FIG. 5 is a combinatorial sectional view of the vacuum fluorescent display.

As shown in the drawings, the vacuum fluorescent display includes a front substrate 4 and a back substrate 6 that are combined with a side glass 2 to thereby form a vacuum cell. A wiring layer electrically interconnects structural components internal to the vacuum cell. An insulating layer 10 prevents unneeded electrical communications among the device components. Anode electrodes are formed on the insulating layer 10. Each anode electrode unit includes a conductive layer 12 electrically connected to the wiring layer 8 via a dot layer, and a phosphor layer 14 formed on the conductive layer 12. A plurality of filaments 16 are fixedly mounted on the anode electrode via filament supports. A control electrode 18 is placed at the periphery of the anode electrode.

The control electrode 18 is formed with a metallic material having a high electrical conductivity while bearing a single-layered structure. The bottom end portion of the control electrode 18 is electrically connected to the wiring layer 8, and sealed to the back substrate 6 via a frit.

The control electrode 18 functions as a grid electrode for accelerating or intercepting the thermal electrons emitted from the filaments 16.

The control electrode 18 is formed with stainless steel. Alternatively, depending upon the device characteristics, a metallic material having an electrical conductivity higher than that of the stainless steel such as platinum, silver, and copper may be used for the control electrode 18.

The control electrode 18 is formed with a predetermined thickness such that it can easily perform the electron control function. The thickness of the control electrode 18 may be varied in accordance with the device characteristics.

The metal rib-based control electrode 18 is structured to surround one anode electrode unit. For instance, in case seven segments come together to form an anode electrode unit, the control electrode surrounds each segment. The control electrode 18 surrounding one anode electrode unit may be formed with a unitary part, or in a separate manner.

Under the application of voltage, the control electrode 18 controls flow of the thermal electrons emitted from the filaments 16 to thereby switch on/off of the seven segments of the anode electrode unit.

Such a control electrode 18 may be formed through the following process.

First, a metal plate having a width corresponding to the target anode electrode unit and a thickness capable of performing the electron control is prepared. The metal plate is partially etched through the usual photolithography process, and removed to thereby complete a metal rib with a particular pattern.

The metal rib is attached at the periphery of the anode electrode via a frit such that the metal rib is electrically connected to the wiring layer 8.

The control electrode 18 may be formed with various patterns, and the portions of the control electrode 18 for electrical communication with the wiring layer 8 and surrounding the anode electrode may be varied in shape in accordance with the device characteristics.

Figure 6:
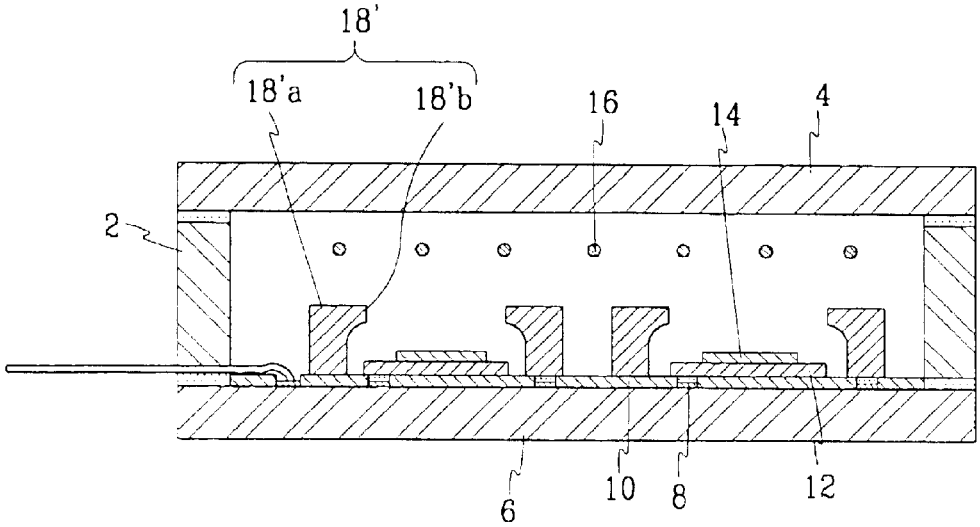
FIG. 6 is a cross sectional view of a vacuum fluorescent display according to a second preferred embodiment of the present invention.

FIG. 6 is a cross sectional view of a vacuum fluorescent display according to a second preferred embodiment of the present invention. In this preferred embodiment, other components and structures are the same as those related to the first preferred embodiment except that the control electrode 18' is differentiated in shape.

As shown in FIG. 6, the control electrode 18' is provided with a main control part 18'*a*, and a subsidiary control part connected to the main control part 18'*a* in a body.

The subsidiary control part 18'*a* is to prevent the brightness and cut-off characteristics of the phosphor layer 14 from being deteriorated when the influential force of the main control part 18'*a* to the central portion of the anode electrode is decreased due to enlargement of the volume of the anode electrode. That is, the subsidiary control part 18'*a* makes the control electrode 18' to exert its control function well over the entire area of the enlarged anode electrode.

The subsidiary control part is formed with an extension 18'*b* where the top end portion of the metal rib is extended toward the anode electrode perpendicular to the main body thereof such that the planar volume of the control electrode 18' is enlarged. In this structure, even if the anode electrode is patterned with a large volume, the control electrode 18' can perform its electronic control function in a fluent manner.

The extension 18'*b* of the control electrode 18' is not overlapped with the phosphor layer 14 such that it does not shadow the display pattern.

Figure 7:
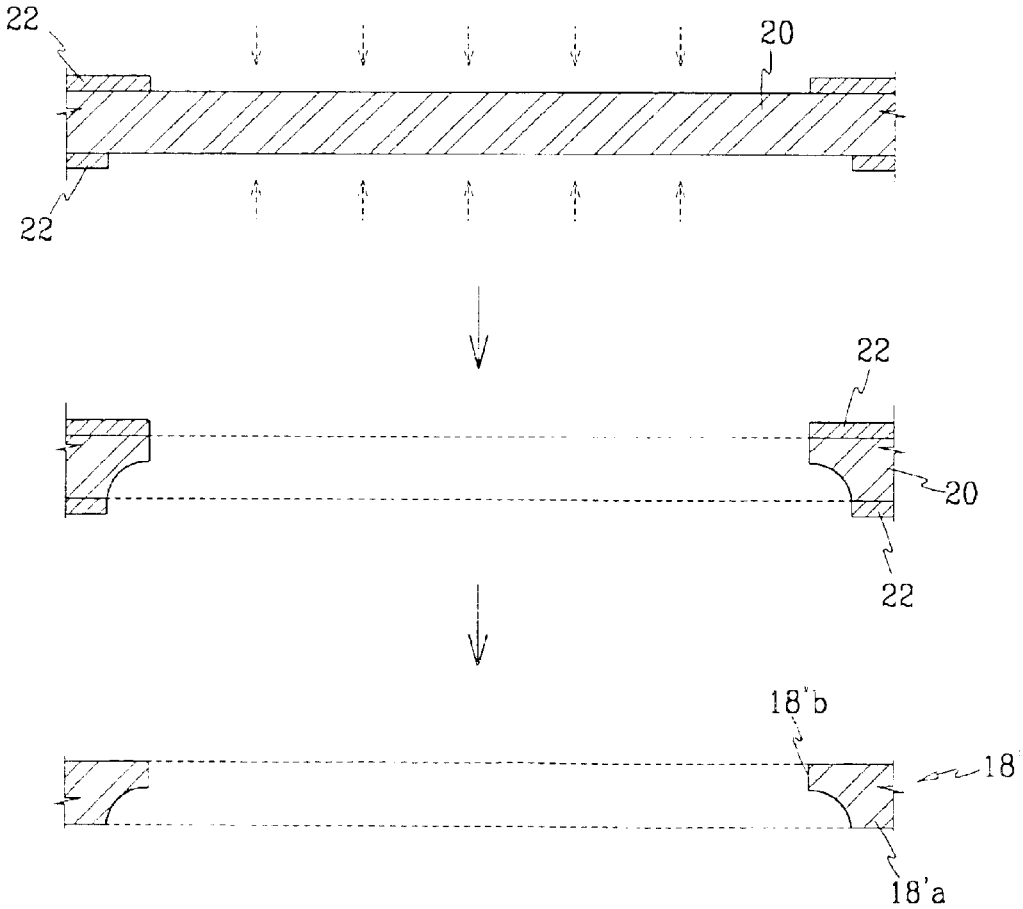
FIG. 7 is a schematic view illustrating the process of forming a control electrode for the vacuum fluorescent display shown in FIG. 6.

As shown in FIG. 7, the control electrode 18' with the extension 18'*b* can be easily formed through making photoresist patterns 22 on both surfaces of a metal plate 20, and double-etching the metal plate 20 through the photoresist patterns 22 such that it has the main control part 18'*a* and the subsidiary control part 18'*b*.

Figure 8:
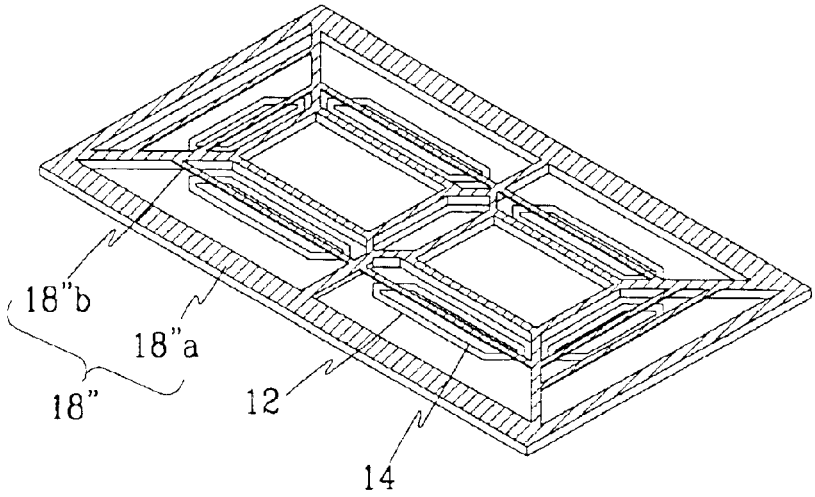
FIG. 8 is a perspective view of a vacuum fluorescent display according to a third preferred embodiment of the present invention.
Figure 9:
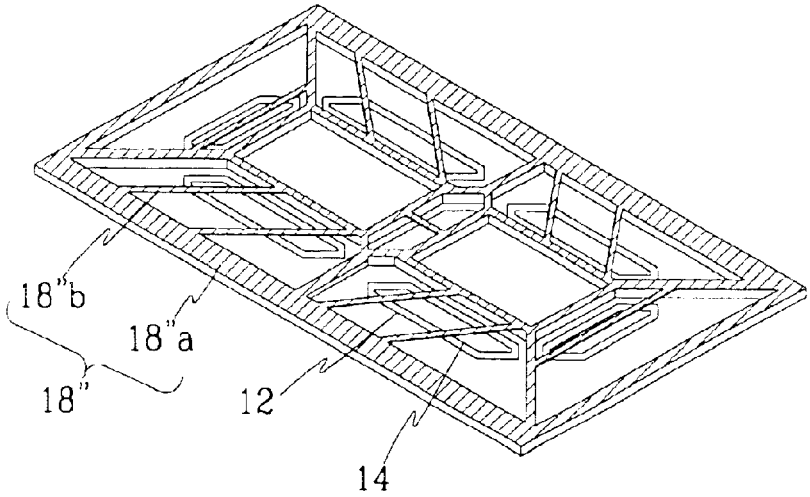
FIG. 9 is a perspective view of a vacuum fluorescent display according to a fourth preferred embodiment of the present invention.
Figure 10:
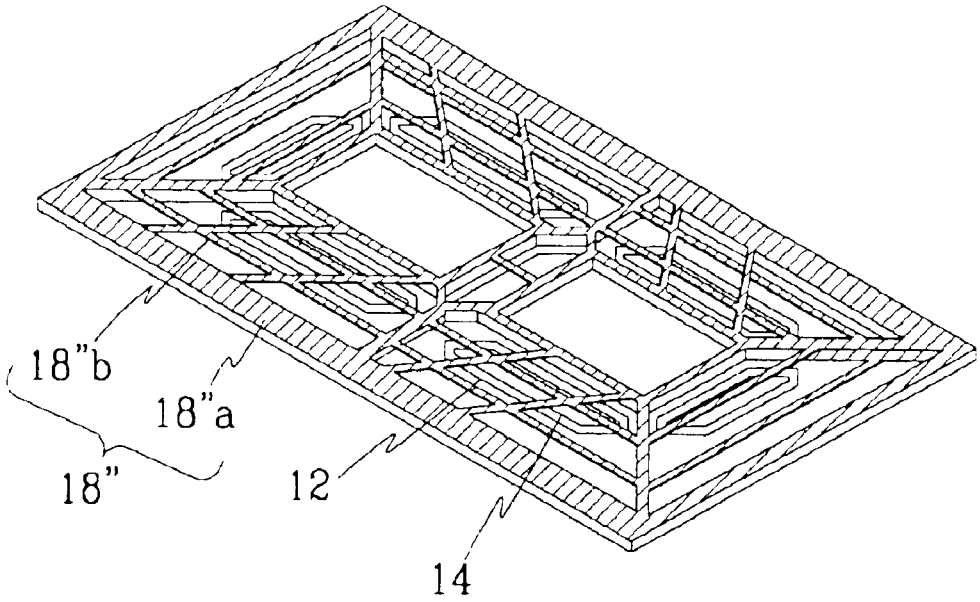
FIG. 10 is a perspective view of a vacuum fluorescent display according to a fifth preferred embodiment of the present invention.
Figure 11:
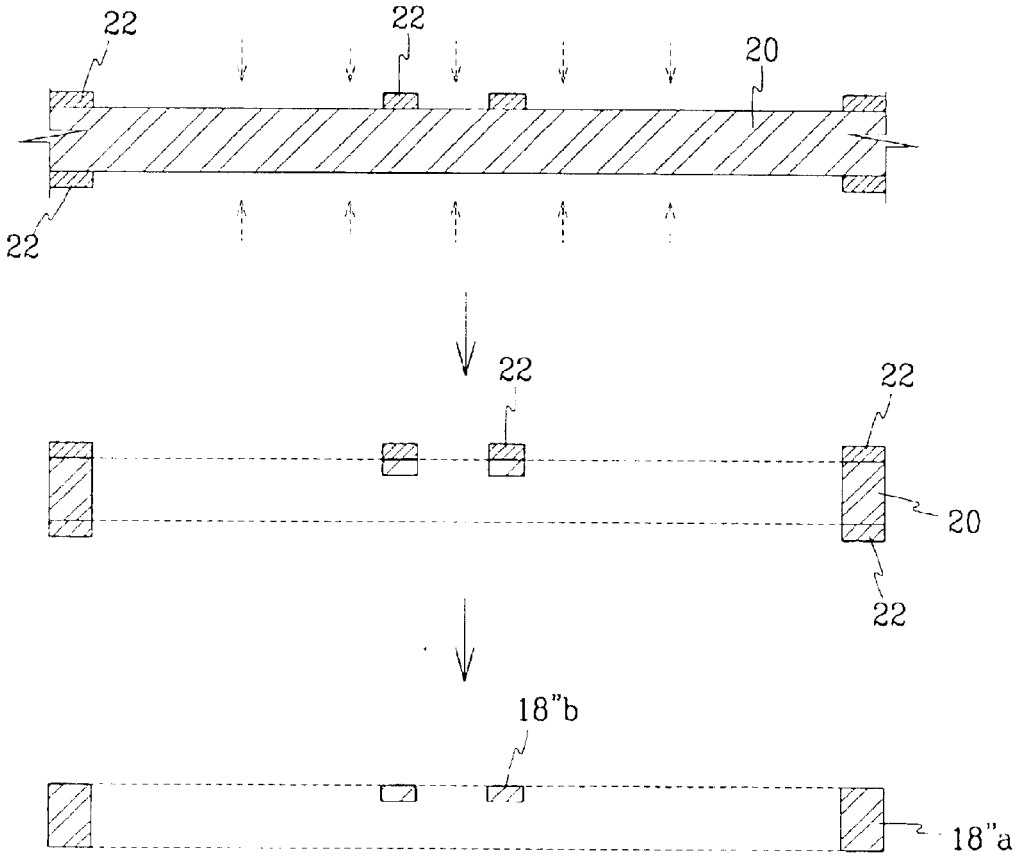
FIG. 11 is a schematic view illustrating the process of forming a control electrode for the vacuum fluorescent displays shown in FIGS. 8 to 10.

FIGS. 8 to 10 illustrate vacuum fluorescent displays according to third to fifth preferred embodiments of the present invention. In these preferred embodiments, other components and structures of the vacuum fluorescent displays are the same as those related to the first preferred embodiment except that a connector 18"*b* is used as the subsidiary control part while interconnecting top portions of the main control unit 18"*a* such that it crosses each segment. As shown in FIG. 11, the control electrode 18" with the connector 18"*b* can be easily formed through making photoresist patterns 22 on both surfaces of a metal plate 20, and double-etching the metal plate 20 through the photoresist patterns 22.

Figure 12:
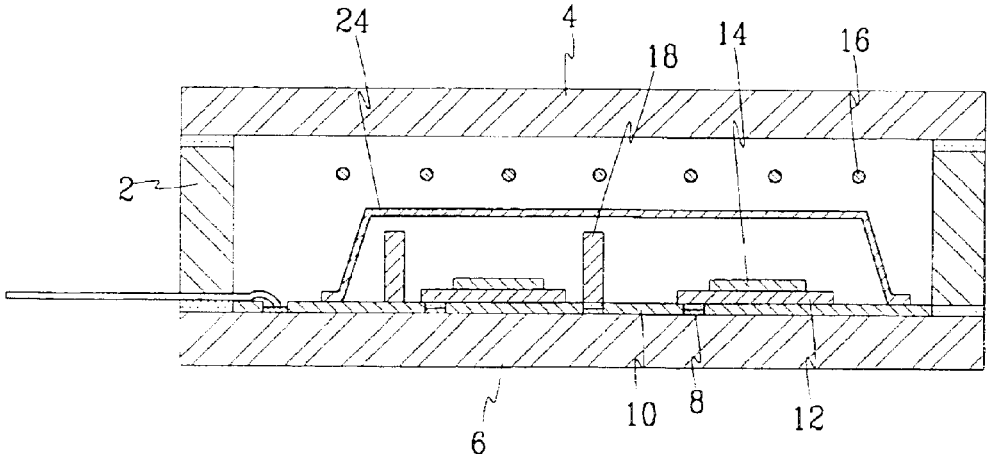
FIG. 12 is a cross sectional view of a vacuum fluorescent display according to a sixth preferred embodiment of the present invention.

FIG. 12 is a cross sectional view of a vacuum fluorescent display according to a sixth preferred embodiment of the present invention where the vacuum fluorescent display has a fourfold electrode structure.

As shown in FIG. 12, the vacuum fluorescent display has a control electrode 18 for controlling the thermal electrons emitted from filaments 16, and a subsidiary electrode 24. The control electrode may be formed with a shape selected from those related to the first to fifth preferred embodiment. The subsidiary control electrode 24 is formed with a usual metal mesh shape surrounding one or more of the control electrode units 18.

Only one of the control electrode 18 and the subsidiary control electrode 24 may be provided at some electrode units to make three-dimensional images to be displayed.

That is, the metal rib-based control electrode 18 is provided only at the anode electrode units shown in the left side of FIG. 12, and the metal mesh-typed subsidiary control electrode 24 covers all of the control electrodes 18 and the anode electrode units shown in the right side of FIG. 12.

Of course, the control electrode 18 may be provided with a subsidiary control part such as an extension 18'*b* or a connector 18"*b*.

As described above, the control electrode for the vacuum fluorescent display can be fabricated in a simplified manner, and perform its electron control function in an effective manner. Furthermore, the subsidiary control electrode may be provided to assist the control electrode while improving the performance characteristics of the device more efficiently.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A vacuum fluorescent display comprising:

a pair of substrates spaced apart from each other with a predetermined distance, the substrates forming a vacuum cell by interposing a side glass;

an insulating layer positioned directly on one of the pair of substrates;

a plurality of filaments mounted within the vacuum cell to emit thermal electrons under the application of voltage;

a plurality of anode electrodes formed at one of the substrates, each anode electrode having a conductive layer positioned directly on the insulating layer and a phosphor layer formed on the conductive layer; and a control electrode surrounding each said anode electrode to accelerate or intercept the thermal electrons emitted from the plurality of filaments;

wherein the control electrode is formed with a single-layered structure and is positioned directly on the insulating layer.

2. The vacuum fluorescent display of claim 1 wherein the control electrode is formed with a metallic material having a high electrical conductivity.

3. The vacuum fluorescent display of claim 2 wherein the control electrode is formed with a metallic material selected from the group consisting of stainless steel, platinum, silver and copper.

4. The vacuum fluorescent display of claim 1 wherein each said anode electrode is formed with a plurality of segments, and the control electrode surrounds each segment of each said anode electrode.

5. The vacuum fluorescent display of claim 4 wherein the control electrode is formed with a unitary part.

6. The vacuum fluorescent display of claim 5 wherein the control electrode comprises a main control part for accelerating and intercepting the thermal electrons, and a subsidiary control part for assisting the main control part in controlling the thermal electrons.

7. The vacuum fluorescent display of claim 6 wherein the main control part surrounds each segment of each said anode electrode, and the subsidiary control part is formed at a top end portion of the main control part with a unitary part.

8. The vacuum fluorescent display of claim 7 wherein the subsidiary control part is formed with an extension where the top end portion of the main control part is extended toward each segment of each said anode electrode perpendicular to the main control part.

9. The vacuum fluorescent display of claim 7 wherein the subsidiary control part is formed with a connector, the connector interconnecting top ends of the main control part such that the connector crosses each segment of the anode electrode.

10. The vacuum fluorescent display of claim 5 further comprising a subsidiary control electrode surrounding the control electrode.

11. The vacuum fluorescent display of claim 10 wherein the subsidiary control electrode is formed with a mesh grid.

12. The vacuum fluorescent display of claim 10 wherein the control electrode and the subsidiary control electrode is provided at some of the plurality of anode electrodes.

13. A vacuum fluorescent display comprising:

a pair of substrates spaced apart from each other with a predetermined distance, the substrates forming a vacuum cell by interposing a side glass;

a plurality of filaments mounted within the vacuum cell to emit thermal electrons under the application of voltage;

a plurality of anode electrodes formed at one of the substrates, each anode electrode having a conductive layer, a phosphor layer formed the conductive layer, and a periphery in a plane parallel to the plane of the one of the substrates; and a control electrode spaced apart from the phosphor layer of each said anode electrode in the plane parallel to the plane of the one of the substrates and surrounding each said anode electrode at the periphery of each said anode electrode to accelerate or intercept the thermal electrons emitted from the plurality of filaments;

wherein the control electrode has a single-layered structure.

14. The vacuum fluorescent display of claim 13 wherein the single-layered structure of the control electrode is a metallic material having a high electrical conductivity.

15. The vacuum fluorescent display of claim 14 wherein the single-layered structure of the control electrode is a metallic material selected from the group consisting of stainless steel, platinum, silver and copper.

16. The vacuum fluorescent display of claim 13 wherein each said anode electrode includes a plurality of segments, and the control electrode surrounds each segment of each said anode electrode.

17. A vacuum fluorescent display comprising:

a pair of substrates spaced apart from each other with a predetermined distance, the substrates forming a vacuum cell by interposing a side glass;

a plurality of filaments mounted within the vacuum cell to emit thermal electrons under the application of voltage;

a plurality of anode electrodes formed at one of the substrates, each anode electrode having a conductive layer and a phosphor layer formed on a first portion of the conductive layer leaving a second portion of the conductive layer exposed to the plurality of filaments; and a control electrode surrounding said second exposed portion of the conductive layer.

18. The vacuum fluorescent display of claim 17 wherein the control electrode is formed with a metallic material having a high electrical conductivity.

19. The vacuum fluorescent display of claim 18 wherein the control electrode is formed with a metallic material selected from the group consisting of stainless steel, platinum, silver and copper.

* * * * *

UNITED STATES PATENT AND TRADEMARK OFFICE

CERTIFICATE OF CORRECTION

PATENT NO. : 6,803,716 B1
DATED : October 12, 2004
INVENTOR(S) : Park et al.

It is certified that error appears in the above-identified patent and that said Letters Patent is hereby corrected as shown below:

Column 6,
Line 58, delete “is provided”, insert -- are provided --.

Column 7,
Line 1, after “layer formed”, insert -- on --.

Signed and Sealed this

Sixteenth Day of August, 2005

JON W. DUDAS
*Director of the United States Patent and Trademark Office*